United States Patent [19]

Mallek et al.

[11] Patent Number: 4,652,404

[45] Date of Patent: Mar. 24, 1987

[54] PROCESS FOR CONDITIONING CONTAMINATED WASTE THROUGH CEMENTING

[75] Inventors: Heinz Mallek, Linnich-Tetz; Egon Zange, Düren; Wolfgang Schlenter, Kreuzau; Karl Trümper, Düren-Kufferath; Siegfried Meininger, Altenstadt; Dietmar Bege, Erlangen, all of Fed. Rep. of Germany

[73] Assignee: Kernforschungsanlage Jülich Gesellschaft mit beschränkter Haftung, Fed. Rep. of Germany

[21] Appl. No.: 676,716

[22] Filed: Nov. 30, 1984

[30] Foreign Application Priority Data

Dec. 1, 1983 [DE] Fed. Rep. of Germany ..... 3343422

[51] Int. Cl.[4] ..... G21F 9/16; G21F 9/14; G21F 9/36

[52] U.S. Cl. ..... 252/628; 106/85; 106/89; 252/632; 252/633; 264/0.5; 264/333

[58] Field of Search ..... 252/628, 632, 631, 633, 252/626; 264/0.5, 333; 106/89, 85, 97, 98; 250/506.1, 517.1

[56] References Cited

U.S. PATENT DOCUMENTS

| | | | |
|---|---|---|---|
| 3,513,100 | 5/1970 | Stogner | 252/628 |
| 3,779,938 | 12/1973 | Weakley | 252/628 |
| 4,017,417 | 4/1977 | Clark et al. | 252/628 |
| 4,113,504 | 9/1978 | Chen et al. | 252/628 |
| 4,122,028 | 10/1978 | Iffland et al. | 252/628 |
| 4,174,293 | 11/1979 | Colombo et al. | 252/628 |
| 4,257,912 | 3/1981 | Fleischer et al. | 252/626 |
| 4,299,722 | 11/1981 | Stock et al. | 252/628 |
| 4,379,081 | 4/1983 | Rootham et al. | 252/628 |

FOREIGN PATENT DOCUMENTS

| | | | |
|---|---|---|---|
| 0032686 | 7/1981 | European Pat. Off. | 252/628 |
| 0020519 | 5/1981 | Japan | 252/628 |
| 0020520 | 5/1981 | Japan | 252/628 |

OTHER PUBLICATIONS

Campbell, M., ed. 1976, High-Level Radioactive Waste Management, American Chemical Society, Washington, D.C. pp. 9–21.

*Primary Examiner*—Stephen J. Lechert, Jr.
*Assistant Examiner*—Howard J. Locker
*Attorney, Agent, or Firm*—Scully, Scott, Murphy & Presser

[57] ABSTRACT

A process for the conditioning of contaminated waste through cementing. Dry waste is cemented, especially waste which is recovered as ashes subsequent to the combustion of burnable waste, or as a dry residue during the treatment of sludge. In the process there is added to the dry waste a cement component not less than about 50% by weight of the weight of the waste, wherein subsequent to the admixing of the waste with the cement, there is mixed in water to the cement in a slightly excess stoichiometric ratio of effecting the setting, and the mixture is compacted under pressure and then encased.

3 Claims, No Drawings

PROCESS FOR CONDITIONING CONTAMINATED WASTE THROUGH CEMENTING

BACKGROUND OF THE INVENTION

1. Field of the Invention

The present invention relates to a process for the conditioning of contaminated waste through cementing. Dry waste is cemented, especially waste which is recovered as ashes subsequent to the combustion of burnable waste, or as a dry residue during the treatment of sludge.

2. Discussion of the Prior Art

It is known that weakly radioactive to medium radioactive waste materials which contain burnable components can be incinerated in combustion furnaces, and radioactive liquids concentrated through evaporation and the obtained sludge processed into a dry residue. Inasmuch as the radioactivity of weakly radioactive to medium radioactive waste materials will only decay within a longer period of time, it is a usual procedure to mix the dry waste with bitumen or cement and to insert it into metal drums. The portion of the dry waste in such cement drums is constituted of about 25% by weight.

Not only radioactive waste materials allow themselves to be encased through cementing. Also toxic waste, which does not permit itself to be further processed and which, due to its solubility in water, is not capable of being directly deposited, can be stored in this manner. The herein employed term "contaminated waste" includes such materials and other deleterious waste comparable therewith which is to be stored.

Of decisive significance in the cementing of contaminated wastes is, on the one hand, the leaching behavior of the compound member obtained subsequent to the setting and hardening of the cement upon contact thereof with water, and, on the other hand, its strength. Sought after is a lowest possible leaching rate for the compound member so that in the event, of an accident involving water ingress in the repository, no contaminated waste enclosed in the compound member can engress into the water. However, also the strength of the compound member, in particular its resistance to pressure and its surface hardness, may not fall below a minimum extent, in order to avoid any abrasion and, as a result, the release of contaminated waste into the environment.

The leaching behavior of the compond member depends to a considerable extent upon its porosity. However, the strength of the compound member is also influenced by the porosity. Consequently, it is an object to obtain the highest possible material density. It is also of significance that the volume which is to be introduced into the repositories for the storage of the contaminated wastes be maintained as small as possible, inasmuch as the space in natural ground which is available for the storage, for example, in salt deposits, is not available to an unlimited degree.

SUMMARY OF THE INVENTION

Accordingly, it is an object of the present invention to provide a process for the conditioning of dry contaminated wastes with a higher concentration of waste in the final product then usual with at least the same leaching behavior. Concurrently, the aim is to improve the strength of the set and hardened compound member, especially its compressive strength surface hardness and resistance to abrasion.

The foregoing object is achieved pursuant to the invention through a process for the conditioning of contaminated waste of the type described in which there is added to the dry waste a cement component which cement component is at least 50% by weight of the total weight of the waste, such that the quantity of dry waste relative to the quantity of cement is present in the ratio of about 2:1, wherein subsequent to the admixing of the waste with the cement, there is mixed in water to the cement in a slightly excess stoichiometric ratio of effecting the setting, and the mixture is compacted under pressure and then encased. The water which is added to the mixture for the setting of the cement is measured so as to be slightly excessively stoichiometric with consideration being given to the setting reaction. After the addition of the water, the mixture evidences a somewhat soil-damp condition. The mixture is then compacted under pressure. During the setting of the cement, the compound member which contains the waste will harden. Pursuant to this process, the component of the dry waste within the compound member which is to be stored is generally double in comparison with the amount of waste which is cemented into the drum in the absence of pressure, without adversely affecting the leaching behavior. As a result, through the compression of the only soil-damp cement-waste mixture which contains only a slight excess of water, there is obtained an end product of high strength with a low surface abrasion.

An advantage attained through effecting the setting of the waste-cement mixture under pressure also consists in that, under these conditions, there can be eliminated any presorting of the waste into waste ashes, waste slag or waste scraps. Under pressure, the flowable components of the waste-cement mixture will also fill out narrow interspaces. The compressed mixture possesses a small volume.

Pursuant to a specific feature of the invention, water is mixed into the waste-cement mixture at a preferred ratio of water:cement in the range of 0.29 to 0.35:1. Hereby, of significance to the lower limit is the required stoichiometric water-cement ratio for the setting of the cement. The upper limit is determined by the compressibility of the mixture, since with an increasing water content there increases the porosity of the encased compound member. The water content must be measured such that, under the application of pressure, no uncombined water can be squeezed out of the mixture. In this connection, it has been ascertained that for the ratio of water:cement, a ratio of 0.3:1 is optimum even under high pressures.

For achieving an adequate compacting of the waste-cement mixture, there is required a pressure of at least about 5 MPa, corresponding to 51 kp/cm$^2$. At a higher pressure, the compacting of the waste-cement mixture increases sub-proportionally; in effect, at compacting under a pressure which is about 8.5 times as high, by about 1.2 times. The compacted mixture is encased in the absence of any pressure.

DESCRIPTION OF PREFERRED EXEMPLARY EMBODIMENTS

The invention is described hereinbelow on the basis of exemplary embodiments.

As waste, dry radioactive ashes produced in a combustion furnace, heterogeneous in structure, in effect unsorted, was mixed with Portland cement in a weight ratio of 2:1. For effecting the setting of the cement, water was added to this mixture in a ratio of water:cement of 0.3:1. The content of dry waste in the mixture which is to be encased thereby consisted of about 60% by weight. In a heretofore employed pressureless process, the ratio of the mass of waste:cement consisted of about 0.65:1, and water:cement of ≧ than 0.4:1. The mixture thereby contained only about 30% by weight of dry waste.

Tabulated hereinbelow in the Table are the densities $\rho$ in g/cm$^3$ achieved through the application of rising pressure p measured in MPa (also specified in kp/cm$^2$) after the setting and hardening of the compound member.

| p MPa = | [kp/cm$^2$] | $\delta$ g/cm$^3$ |
|---|---|---|
| 5.0 | 51 | 1.69 |
| 10.0 | 102 | 1.75 |
| 15.0 | 153 | 1.81 |
| 20.0 | 204 | 1.87 |
| 25.0 | 255 | 1.89 |
| 42.4 | 432 | 2.01 |

From the Table there can be ascertained that at a pressure rise of about 8.5 times, there can be achieved a density charge of about 1.2 times.

Notwithstanding the high content of dry waste in the compound member, the corrosion phenomena after a 42 day stay in deionized water were only slight and comparable with those of compound members which were produced as test members from the same ashes through a pressureless cementing process and which possessed a lower waste content. The leaching characteristics were similar. Thus, in comparison with a waste-free cement component which was produced in an unpressurized mode through the addition of water to cement in the ratio of 0.28:1, and wherein, after 14 days there had leached out 1.29% of the total mass, in a compound member produced in an unpressurized mode with a waste content of about 30% by weight, there was determined within the same time interval a leaching rate of 1.45% of the total mass, and for a compound member with a waste content of about 60% by weight, which was compacted under a pressure of 7 MPa, a leaching of 1.71% of the total mass.

Through the compression of the waste-cement mixture, in contrast with compound members produced by an unpressurized process, the mass of ashes introducible into a preset end volume could be increased by 82% at a pressure of p=5 MPa, and by 117% at a pressure of p=42 MPa. The reduction in volume through transition from raw ashes to the pressed compound member composed of ashes, cement and water was significant. At a pressure of p=25 MPa there was obtained a volumetric reduction by the factor of 2.7; in the unpressurized process this factor was near to 1.

What is claimed is:

1. In a process for the conditioning of contaminated waste through cementing, especially waste in the form of ashes obtained after the combustion of burnable waste or which is recovered as a dry residue during the treatment of sludge; the improvement comprising: adding a cement component to the dry waste which cement component is at least 50% by weight of the total weight of the waste, such that the quantity of dry waste relative to the quantity of cement is present in a ratio of about 2:1 by weight; adding water to the cement after the admixing of the waste with the cement for the setting of the cement, said water being in a slightly excess stoichiometric ratio to the cement to form a generally crumbly consistency; and compacting the mixture under pressure of at least about 7 MPa, and encasing the mixture.

2. A process as claimed in claim 1, wherein said water is added in the ratio of the mass of water:cement in the range of 0.29 to 0.35:1.

3. A process as claimed in claim 2, wherein the ratio of the mass of water:cement comprises 0.3:1.

* * * * *

UNITED STATES PATENT AND TRADEMARK OFFICE

CERTIFICATE OF CORRECTION

PATENT NO. : 4,652,404

DATED : March 24, 1987

INVENTOR(S) : Heinz Mallek, et al.

It is certified that error appears in the above-identified patent and that said Letters Patent is hereby corrected as shown below:

On the title page, change assignee to read:

--Kernforschungsanlage Julich Gesellschaft Mit Beschränkter Haftung & Kraftwerk Union AG, both Fed. Rep. of Germany--.

Signed and Sealed this

Ninth Day of August, 1988

*Attest:*

DONALD J. QUIGG

*Attesting Officer*

*Commissioner of Patents and Trademarks*